US009523472B2

(12) United States Patent
Ahn et al.

(10) Patent No.: US 9,523,472 B2
(45) Date of Patent: Dec. 20, 2016

(54) VEHICLE LIGHTING APPARATUS HAVING A LENS SEATED ON MOVABLE MEMBER SLIDINGLY COUPLED TO SUPPORT MEMBER THAT IS COUPLED TO LIGHT SOURCE SECTION

(71) Applicant: HYUNDAI MOTOR COMPANY, Seoul (KR)

(72) Inventors: Byoung Suk Ahn, Suwon-si (KR); Young Sub Oh, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 81 days.

(21) Appl. No.: 14/608,075

(22) Filed: Jan. 28, 2015

(65) Prior Publication Data

US 2016/0109085 A1 Apr. 21, 2016

(30) Foreign Application Priority Data

Oct. 15, 2014 (KR) ..... 10-2014-0138793

(51) Int. Cl.
*F21S 8/10* (2006.01)

(52) U.S. Cl.
CPC ..... *F21S 48/1241* (2013.01); *F21S 48/1145* (2013.01); *F21S 48/1208* (2013.01); *F21S 48/1317* (2013.01); *F21S 48/214* (2013.01); *F21S 48/215* (2013.01); *F21S 48/2206* (2013.01); *F21S 48/2212* (2013.01); *F21S 48/2237* (2013.01); *F21S 48/2268* (2013.01); *F21S 48/2287* (2013.01); *F21S 48/24* (2013.01); *F21S 48/328* (2013.01)

(58) Field of Classification Search
CPC .... F21S 48/1145; F21S 48/1721; F21S 48/17; F21S 48/1241; F21V 14/06; F21V 17/02
See application file for complete search history.

(56) References Cited

U.S. PATENT DOCUMENTS 5,791,768 A * 8/1998 Splane, Jr. ..... F21V 7/0025 362/280
9,335,016 B2 * 5/2016 Nakazato ..... F21S 48/1145
2013/0258689 A1 * 10/2013 Takahira ..... F21S 48/17 362/465

FOREIGN PATENT DOCUMENTS

| | | | |
|---|---|---|---|
| JP | 2000-098211 | A | 4/2000 |
| JP | 2012-174601 | A | 9/2012 |
| JP | 2012-243538 | A | 12/2012 |
| JP | 2013-089555 | A | 5/2013 |
| JP | 2014-082057 | A | 5/2014 |
| KR | 10-2010-0037298 | A | 4/2010 |

(Continued)

OTHER PUBLICATIONS

Korean Office Action dated Feb. 15, 2016 issued in Korean Patent Application No. 10-2014-0138793.

*Primary Examiner* — Robert May
(74) *Attorney, Agent, or Firm* — McDermott Will & Emery LLP

(57) ABSTRACT

A vehicle lighting apparatus includes a light source section and a lens disposed at a front side of the light source section to refract light from the light source section. A movable member has an end portion on which the lens is seated. A support member has an end portion which is coupled to the light source section and slidably coupled to the movable member such that the movable member is movable in a forward and rearward direction of the light source section.

14 Claims, 6 Drawing Sheets

(56) References Cited

FOREIGN PATENT DOCUMENTS

KR 10-2014-0114306 A 9/2014

* cited by examiner

VEHICLE LIGHTING APPARATUS HAVING A LENS SEATED ON MOVABLE MEMBER SLIDINGLY COUPLED TO SUPPORT MEMBER THAT IS COUPLED TO LIGHT SOURCE SECTION

CROSS-REFERENCE TO RELATED APPLICATION

The present application claims the benefit of priority to Korean Patent Application No. 10-2014-0138793, filed Oct. 15, 2014, the entire contents of which is incorporated herein for all purposes by this reference.

TECHNICAL FIELD

The present disclosure relate to a vehicle lighting apparatus, and more particularly, to a vehicle lighting apparatus capable of varying an intensity of light from a light source.

BACKGROUND

A variety of lighting apparatuses are used in a vehicle. From among these lighting apparatuses, a headlight illuminates a front view of the vehicle to secure a clear view when a driver drives at night and to warn oncoming vehicles aware of the presence of the vehicle.

The headlight has an allowable illumination angle range to prevent the light from continuously emitting to drivers' eyes of the oncoming vehicles in the traffic regulations. In this case, the headlight as described above is referred to as "a low beam," and the headlight by which light is temporarily emitted over a very long distance as necessary is referred to as "a high beam."

The low and high beams have different modules due to different light illumination ranges. In this case, the low and high beams utilize different types of light sources and reflectors as necessary.

However, the high and low beams have to be separately modularized in independent production lines. For this reason, production efficiency is deteriorated and cost of the vehicle increases. Accordingly, there is a need to develop a module used in common for the high and low beams and to provide a lighting apparatus having an illumination range suitable for the high and low beams.

The matters described as the related art have been provided only for assisting in the understanding for the background of the present disclosure and should not be considered as corresponding to the related art already known to those skilled in the art.

SUMMARY

The present disclosure is directed to a vehicle lighting apparatus capable of reducing module production cost and improving productivity by allowing light source modules used in different lighting apparatuses to be used as a common module.

Other objects and advantages of the present disclosure can be understood by the following description, and become apparent with reference to the embodiments of the present inventive concept. Also, it is obvious to those skilled in the art to which the present disclosure pertains that the objects and advantages of the present disclosure can be realized by the means as claimed and combinations thereof.

In accordance with an embodiment of the present inventive concept, a vehicle lighting apparatus includes a light source section and a lens disposed at a front side of the light source section to refract light from the light source section. A movable member has an end portion to which the lens is seated. A support member has an end portion coupled to the light source section while being slidably coupled to the movable member such that the movable member is movable in a forward and rearward direction of the light source section.

The light source section may include a light source for generating light and a heat sink having a plurality of cooling fins to cool heat generated by the light source.

The movable member may have a cylindrical shape, and planar cutting faces may be respectively formed on one surface and the other surface, which are symmetrical to each other, on an outer peripheral surface of the movable member.

A thread may be formed continuously along the outer peripheral surface of the movable member in a longitudinal direction thereof, and the thread may be formed on a portion in which the cutting faces are not formed on the outer peripheral surface.

The support member may be in a pair and protrude forward, and inner surfaces of the pair of support members may contact the cutting faces to guide the movable member.

The vehicle lighting apparatus may further include an operation nut having an inner peripheral surface into which the pair of support members and the movable member are inserted into and with which a thread of the movable member engages. The movable member may be moved forward or rearward along with rotation of the operation nut.

The vehicle lighting apparatus may further include a housing provided at a front side of the support member to cover the front side of the support member. The housing may have one side opened toward the support member and a hollow formed such that the movable member is movable therein.

A through-hole may be formed on another side of the housing, and a fluorescent body may be provided in the through-hole.

The light source may be laser.

The housing may further include a reflector provided on a front surface thereof to reflect light emitted via the fluorescent body.

DETAILED DESCRIPTION OF EMBODIMENTS

Figure 1A:
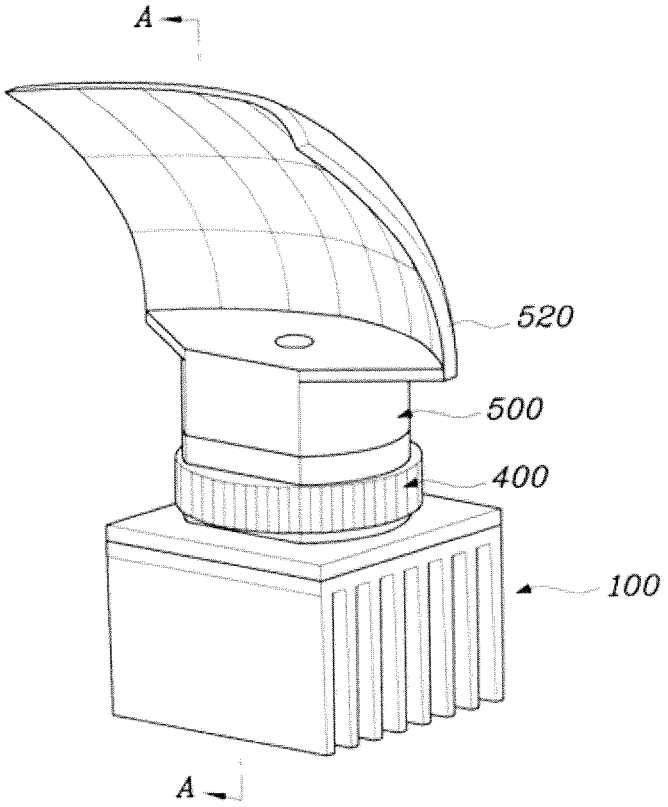
FIG. 1A is an assembled view illustrating a vehicle lighting apparatus according to an embodiment of the present inventive concept.

A vehicle lighting apparatus according to an exemplary embodiment of the present inventive concept will be described below in more detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present inventive concept.

Figure 1B:
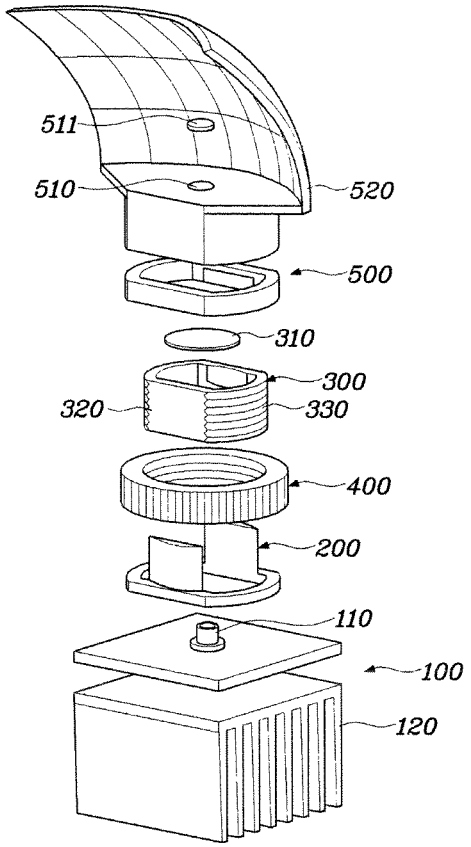
FIG. 1B is an exploded view illustrating the vehicle lighting apparatus according to the embodiment of the present inventive concept.

FIG. 1A is an assembled view illustrating a vehicle lighting apparatus according to an embodiment of the present inventive concept. FIG. 1B is an exploded view illustrating the vehicle lighting apparatus according to the embodiment of the present inventive concept. The vehicle lighting apparatus includes a light source section 100, a lens 310 disposed at a front side of the light source section 100 to refract light from the light source section 100, a movable member 300 configured such that the lens 310 is seated to an end portion of the movable member 300, and support members 200 end portions of which are coupled to the light source section 100 while slidably coupled to the movable member 300 such that the movable member 300 is movable in a forward and rearward direction of the light source section 100.

In more detail, the light source section 100 may include a light source 110 for generating light, and a heat sink 120 having a plurality of cooling fins to cool heat generated by the light source 110. The heat sink 120 is installed on a rear surface of the light source 110. Although the heat sink 120 has been described as having the cooling fins in the embodiment, the present inventive concept is not limited thereto. For example, a heat pipe may also be applied and any form may also be used as long as cooling is performed.

High heat generated by the light source 110 may be effectively dissipated since the light source 110 is integrally coupled to the heat sink 120, and complexity of the layout due to individual installation of components may be relieved since the light source 110 and the heat sink 120 are modularized as the light source section 100.

Laser may be used as the light source 110, but various elements such as a light-emitting diode (LED) may be, of course, used as the light source 110.

One end portion of each of the support members 200 may be fixed to the light source section 100 such that movement of the movable member 300 may be guided. A substrate or support panel on which the light source 110 is mounted may be provided between the light source 110 and the heat sink 120, and one end portion of each support member 200 is coupled to the substrate or the support panel. Various processes such as bonding, fastening, bolting, and welding may be used as a coupling method. The support members 200 may also be directly coupled to the heat sink 120.

The light source section 100, the support members 200, and the movable member 300 may be configured as one module since the support members 200 are fixed to the light source section 100. In addition, the configuration may be simplified and the installation may be easily performed since a separate structure for fixing the support members 200 is not required. The pair of support members 200 may be connected to each other for improvement of safety.

The support members 200 may also be installed to a separate structure, instead of the substrate or the heat sink 120.

The movable member 300 has a cylindrical shape, planar cutting faces 320 may be respectively formed on one surface and the opposite surface which are symmetrical to each other on an outer peripheral surface of the movable member 300. The movable member 300 is not limited to having the cylindrical shape, and may have various shapes such as a polygonal shape. In addition, a thread 330 is continuously formed along the outer peripheral surface of the movable member 300 in a longitudinal direction thereof, and the thread 330 may be formed on a portion in which the cutting faces 320 are not formed on the outer peripheral surface.

In addition, the pair of support members 200 may protrude forward, and inner surfaces of the support members 200 may come into contact with the cutting faces 320 to guide the movable member 300.

In addition, the vehicle lighting apparatus further includes an operation nut 400 configured such that the pair of support members 200 and the movable member 300 are inserted into an inner peripheral portion of the operation nut 400 and an inner peripheral surface of the operation nut 400 engages with the thread 330 of the movable member 300. The movable member 300 may move in the forward or rearward direction along with rotation of the operation nut 400. Here, the forward direction may be a direction in which light is emitted from the light source 110.

The formation of the cutting faces 320 may prevent the movable member 300 from rotating together when the operation nut 400 rotates, and the movable member 300 may change to move in the forward and rearward direction by the rotation of the operation nut 400. Accordingly, each of the cutting faces 320 may be formed according to a length of the movable member 300, or may have a predetermined width set by experiment to such an extent that the movable member 300 is not rotated together when the operation nut 400 rotates.

The pair of cutting faces 320 are provided for stable support in the embodiment, but one cutting face may also be formed on the outer peripheral surface of the movable member 300, and three or more cutting faces may also be formed instead of the pair of cutting faces 320.

The support members 200 may be provided according to the number of the cutting faces 320 formed on the movable member 300. The same cutting faces may be formed on inner peripheral surfaces of the support members 200 coming into contact with the cutting faces 320 so as not to rotate the movable member 300, and the inner peripheral surface of each of the support members 200 may have a width to such an extent as to come into full contact with the associated cutting face. In addition, the support member 200 may set to have a length protruding to continuously maintain a contact state even though the movable member 300 moves forward.

An outer peripheral surface of each support member 200 may have an arc shape corresponding to the inner peripheral surface of the operation nut 400. This enables the support members 200 to be inserted into the operation nut 400 and secure the rotation of the operation nut 400.

Figure 2:
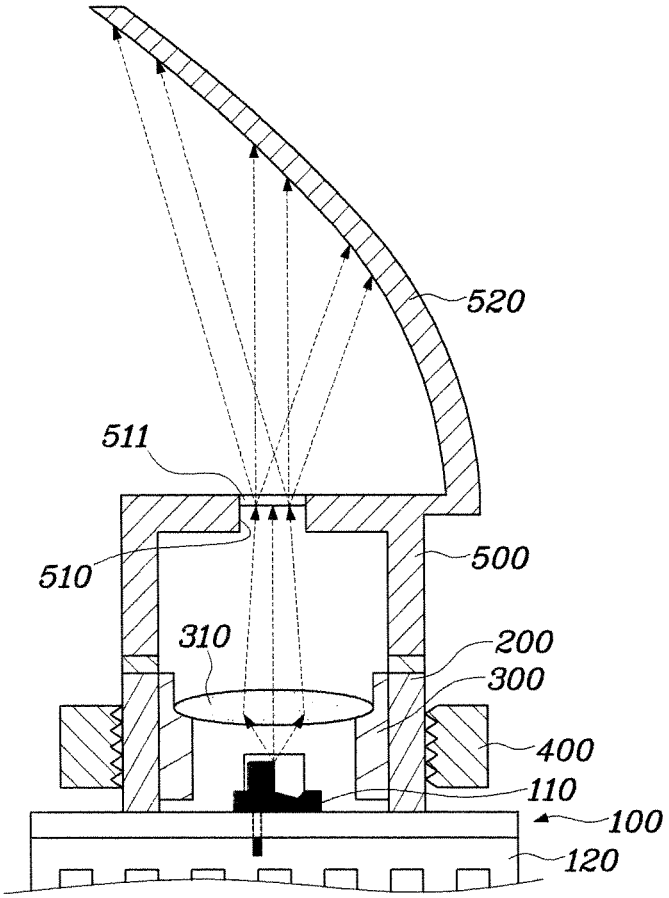
FIG. 2 is a cross-sectional view taken along line A-A in FIG. 1A at the time of short-distance illumination.
Figure 3:
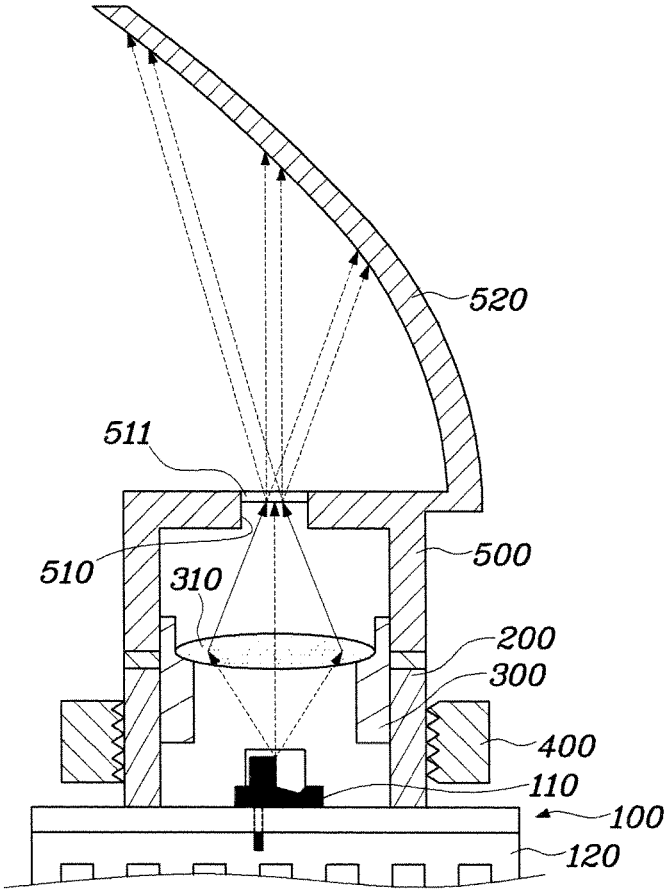
FIG. 3 is a cross-sectional view taken along line A-A in FIG. 1A at the time of long-distance illumination.

FIG. 2 is a cross-sectional view taken along line A-A in FIG. 1A at the time of short-distance illumination. FIG. 3 is a cross-sectional view taken along line A-A in FIG. 1A at the time of long-distance illumination. As shown in FIGS. 2 and 3, the movable member 300 and the lens 310 located at the end portion of the movable member 300 move along with the rotation of the operation nut 400, thereby enabling a distance between the lens 310 and the light source 110 to be varied.

When the lens 310 moves toward the light source 110, an amount of refraction of light decreases, and thus, a degree of concentration of light is low, so that a radiation radius of light output from the lens 310 is gradually increased. On the contrary, when the lens 310 is away from the light source 110, namely, moves forward from the light source 110, an amount of refraction of light is increased, and thus, a degree of concentration of light is high, so that the radiation radius of light output from the lens 310 is gradually decreased.

The radiation radius of light output according to the lens 310 and the movable member 300 is varied. Therefore, long-distance illumination in a low beam may be performed in such a manner that the radiation radius of light is increased by decreasing the distance between the lens 310 and the light source 110, and long-distance illumination in a headlight may be performed in such a manner that the radiation radius of light is decreased by increasing the distance between the lens 310 and the light source 110. As such, since lighting is performed in various forms through one light source module, it may be possible to accomplish improvement in productivity, easy assembly, and reduction of unit cost.

The vehicle lighting apparatus may further include a housing 500, which is provided at a front side of the support members 200, covers the opened front side of the support members 200, has one side opened toward the support members 200, and has a hollow formed such that the movable member 300 may move therein. In addition, a through-hole 510 is formed on another side of the housing 500, and a fluorescent body 511 may be provided in the through-hole 510. The other side of the housing 500 may be closed except for the through-hole 510.

The housing 500 covers the opened front of the assembly of the operation nut 400, the support members 200, and the movable member 300. Light from the light source 110 may be radiated to the outside only through the fluorescent body 511 to prevent risks caused when laser is emitted to the outside without passing the fluorescent body 511, for example, a blindness risk caused when laser reaches driver's eyes of an oncoming vehicle. Here, when the laser light is received in the fluorescent body 511, the fluorescent body 511 outputs the laser light as white light. One end portion of the housing 500 may be coupled to other end portions of the support member 200 such that the housing 500 does not rotate when the operation nut 400 rotates.

The through-hole 510 may be formed in various shapes according to a desired illumination form of light. For example, the through-hole 510 may have a circular shape or a polygonal shape. Of course, the fluorescent body 511 may be formed corresponding to the shape of the through-hole 510.

A front surface of the housing 500 may be further provided with a reflector 520 which reflects light emitted via the fluorescent body 511 to the outside of the housing 500. The reflector 520 may be configured in various forms, and may have various shapes such as an oval shape and a spherical shape according to the illumination range and form of light.

In addition, without provision of the reflector 520, light transmitting the fluorescent body 511 may also be directly radiated forward.

In an alternative embodiment, a light guide may be installed instead of the reflector 520 to correspond to the through-hole 510. The light guide is a device for uniformly emitting light while the light moves along the inside of the light guide when the light is incident thereon.

Figure 4:
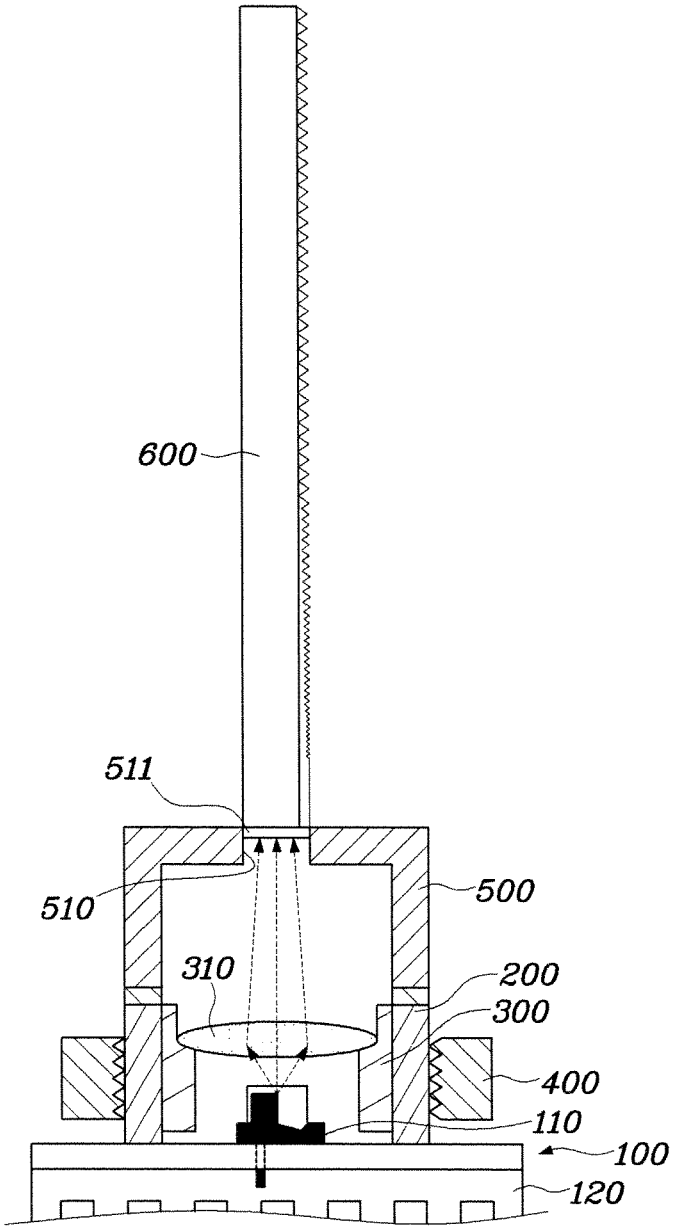
FIGS. 4 and 5 are views illustrating a configuration of the vehicle lighting apparatus equipped with a light guide.
Figure 5:
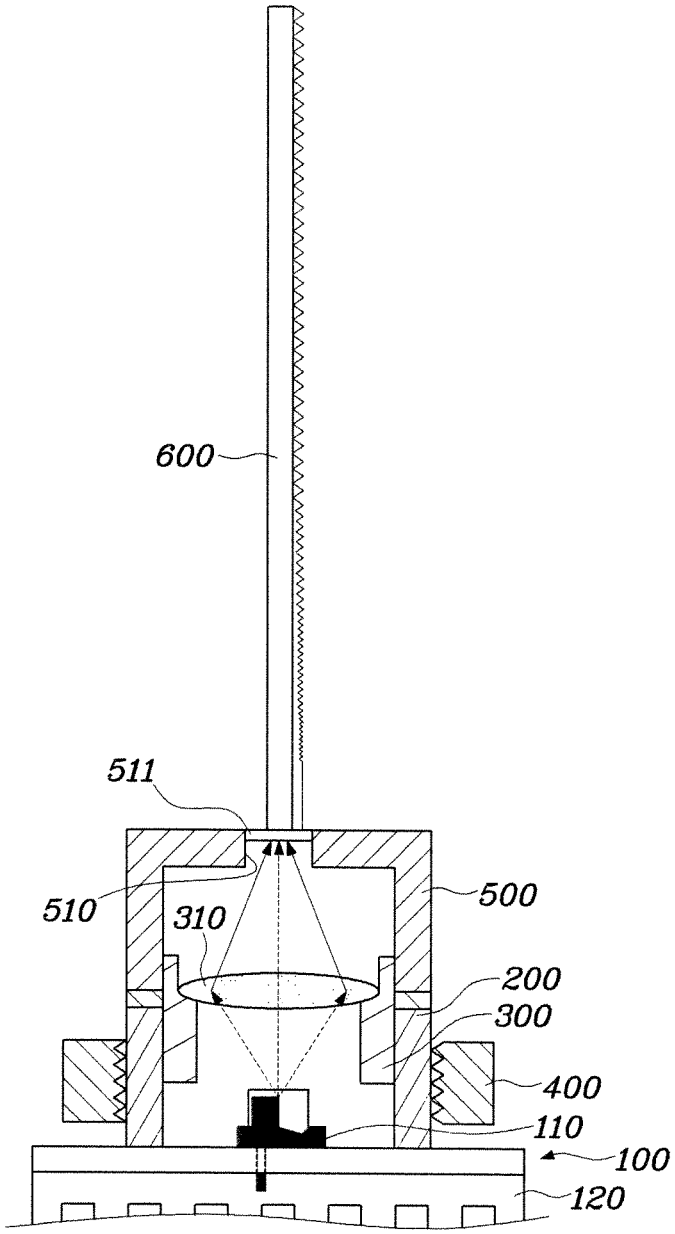

FIGS. 4 and 5 are views illustrating the vehicle lighting apparatus having a light guide. FIG. 4 illustrates a light guide having a diameter similar to that of the fluorescent body 511, and FIG. 5 illustrates a light guide having a smaller diameter than that of the fluorescent body 511.

As shown in FIG. 4, when a cross-sectional diameter of the light guide 600 is similar to that of the fluorescent body 511, light from the light source 110 may be entirely incident on a cross-sectional area of the light guide 600 abutting the fluorescent body 511 in such a manner that a radiation diameter of light incident on the light guide 600 is increased by decreasing the distance between the lens 310 and the light source 110.

On the contrary, as shown in FIG. 5, when the cross-sectional diameter of the light guide 600 is smaller than that of the fluorescent body 511, the light from the light source 110 may be incident to correspond to the cross-sectional area of the light guide 600 in such a manner that the radiation diameter of light output therefrom is decreased by increasing the distance between the lens 310 and the light source 110.

Accordingly, the distance between the lens 310 and the light source 110 may be set to be varied according the diameter of the light guide 600, and thus, different light sources need not be provided according to the size and type of the light guide 600. Consequently, productivity may be efficiently increased.

The light guide 600 may be supported through a separate fixing structure, or may be supported in such a manner that an end portion thereof is bonded around the through-hole.

According to the vehicle lighting apparatus having the above-mentioned structure, it may be possible to reduce production cost and improve productivity of the vehicle by allowing light source modules to be used as a common module form even though the light source modules are used in different lighting apparatuses such as high beams, low beams, and taillights.

In addition, various forms of light may be realized according to the form of the fluorescent body.

In addition, the vehicle lighting apparatus may be applied to various lighting apparatus, in addition to the high beams, the low beams, and the taillights, by varying an intensity of light output from the light source.

In accordance with a vehicle lighting apparatus according to the exemplary embodiment of the present inventive concept, it may be possible to reduce production cost and improve productivity of a vehicle by allowing light source modules to be used as a common module form even though the light source modules are used in different lighting apparatuses such as high beams, low beams, and taillights.

In addition, various forms of light may be realized according to the form of a fluorescent body.

The vehicle lighting apparatus may be applied to various lighting apparatus, in addition to high beams, low beams, and taillights, by varying an intensity of light output from a light source.

While the present inventive concept has been described with respect to the specific embodiments, it will be apparent to those skilled in the art that various changes and modifications may be made without departing from the spirit and scope of the invention as defined in the following claims.

What is claimed is:

1. A vehicle lighting apparatus comprising:

a light source section;

a lens disposed at a front side of the light source section to refract light from the light source section;

a movable member having an end portion on which the lens is seated; and a support member having an end portion which is coupled to the light source section and slidably coupled to the movable member such that the movable member is movable in a forward and rearward direction of the light source section, wherein the movable member has a cylindrical shape, and planar cutting faces are respectively formed on one surface and the opposite surface of the movable member, which are symmetrical to each other, on an outer peripheral surface of the movable member, wherein the support member is configured as a pair of support members to protrude forward, and inner surfaces of the pair of support members come into contact with the planar cutting faces to guide the movable member, wherein the vehicle lighting apparatus further comprises an operation nut having an inner peripheral portion, into which the pair of support members and the movable member are inserted and an inner peripheral surface of the operation nut engages with a thread of the movable member, wherein the movable member moves forward or rearward along with rotation of the operation nut.

2. The vehicle lighting apparatus of claim 1, wherein the light source section comprises:

a light source for generating the light; and a heat sink having a plurality of cooling fins to cool heat generated by the light source.

3. The vehicle lighting apparatus of claim 2, wherein the light source is laser.

4. The vehicle lighting apparatus of claim 2, wherein the heat sink is provided on a rear surface of the light source.

5. The vehicle lighting apparatus of claim 1, wherein a thread is continuously formed along the outer peripheral surface of the movable member in a longitudinal direction thereof, and the thread is formed on a portion in which the planar cutting faces are not formed on the outer peripheral surface.

6. The vehicle lighting apparatus of claim 1, further comprising a housing provided at a front side of the support member to cover the front side of the support member, the housing having one side opened toward the support member and a hollow formed such that the movable member is movable therein.

7. The vehicle lighting apparatus of claim 6, wherein a through-hole is formed on another side of the housing, and a fluorescent body is provided in the through-hole.

8. The vehicle lighting apparatus of claim 7, wherein the housing further comprises a reflector provided on a front surface thereof to reflect the light emitted via the fluorescent body.

9. The vehicle lighting apparatus of claim 7, wherein the housing further comprises a light guide provided to correspond to the through-hole, along which the light moves when the light is incident thereon.

10. The vehicle lighting apparatus of claim 9, wherein when a cross-sectional diameter of the light guide is similar to that of the fluorescent body, the light from the light source is entirely incident on a cross-sectional area of the light guide abutting the fluorescent body.

11. The vehicle lighting apparatus of claim 9, wherein when a cross-sectional diameter of the light guide is smaller than that of the fluorescent body, the light from the light source is incident on an area corresponding to a cross-sectional area of the light guide.

12. The vehicle lighting apparatus of claim 9, wherein the light guide is supported through a separate fixing structure or an end portion thereof and is bonded around the through-hole.

13. The vehicle lighting apparatus of claim 1, wherein the support member is provided in plural corresponding to the number of the planar cutting faces.

14. The vehicle lighting apparatus of claim 1, wherein an outer peripheral surface of each support member has an arc shape corresponding to the inner peripheral surface of the operation nut.

* * * * *